United States Patent [19]

Mueller

[11] Patent Number: 5,045,352

[45] Date of Patent: Sep. 3, 1991

[54] METHOD FOR CLEANING AND COATING WATER-CONDUCTING PIPES

[76] Inventor: Herr Mueller, Speckweg 69, D-6800 Mannheim 1, Fed. Rep. of Germany

[21] Appl. No.: 306,317

[22] Filed: Feb. 3, 1989

[30] Foreign Application Priority Data

Feb. 5, 1988 [DE] Fed. Rep. of Germany ..... 3803410

[51] Int. Cl.[5] ..... B05D 7/22; B05D 3/00

[52] U.S. Cl. ..... 427/235; 15/104.31; 15/316.1; 134/3; 134/22.12; 134/28; 134/36; 134/37; 134/39; 134/40; 427/230; 427/236; 427/238; 427/239; 427/299; 427/327; 427/421

[58] Field of Search ..... 427/235, 230, 238, 236, 427/239, 299, 327, 421; 134/3, 22.12, 28, 36, 37, 40, 39; 15/104.31, 316 R

[56] References Cited

U.S. PATENT DOCUMENTS 3,003,899 10/1961 Eberhard et al. ..... 134/212.12

4,216,738 8/1980 Muta ..... 427/235

4,425,385 1/1984 Coulter ..... 427/235

4,508,577 4/1985 Conn et al. ..... 134/22.12

4,786,525 11/1988 Kayser et al. ..... 427/236

*Primary Examiner*—Janyce Bell

*Attorney, Agent, or Firm*—Sixbey, Friedman, Leedom & Ferguson

[57] ABSTRACT

A method of cleaning and coating water conducting pipes is provided wherein a mixture of water and compressed air is forced through the emptied pipe system to rough clean such system, a pressurized acid is introduced into the pipe system and allowed to react with the interior surface of the pipes for a predetermined period of time. The acid is then drained from the pipes, and the interior of the pipes is dried by compressed air. A pressurized liquid plastic is then introduced into the pipes to coat the pipes with the excess plastic being subsequently drained from the pipe system.

18 Claims, No Drawings

METHOD FOR CLEANING AND COATING WATER-CONDUCTING PIPES

TECHNICAL FIELD OF THE INVENTION

The present invention relates to a method of cleaning and coating pipes, and more particularly, to a method of cleaning and coating the interior surface of pipes which conduct water in residential as well as industrial environments.

BACKGROUND OF THE INVENTION

Over time, the chemical composition of drinking water passing through metallic pipes will lead to corrosion of and/or a scale formation on the interior walls of the conducting pipe system. In residential or industrial buildings, dissambling and rerouting of the water-conducting pipe system would entail extensive labor and expense while posing an extreme inconvenience to the tenants being serviced by this system.

The hardness of water being conducted through these pipes varies widely from very-soft to very-hard depending on the geographical region of where the source originates. Very-soft to soft water, i.e. water containing little or no magnesium or calcium, attacks the interior surface of the pipes resulting in metal-dissolution over the entire wetted surface. This debris is then carried through the pipes to the eventual user of the water.

With medium to hard water, there is often an interaction between corrosion and the formation of a protective layer. As a result, blister-like corrosion products form and attached to the wetted portions of the pipe. These products will lead to the subsurface formation of rust, they may be conveyed by the water flow and precipitate on bare metal surfaces, or they may ultimately be discharged to the consumer.

When conducting hard to very-hard water through the pipe system, a buildup of scale formation or deposits will occur. Additionally, this phenomenon will be enhanced with even a slight rise in temperature thereby accelerating the precipitation of carbonate, whereby, as a rule, oxidation cannot take place. These scale formations or deposits will grow continuously ultimately resulting in the clogging of the pipes or similar undesired consequences in a relatively short period of time.

As stated above, an increase in the temperature of the system will result in the acceleration of the chemical and electro-chemical reactions taking place. Consequently, the hot water system of a heating plant evinces, after only a short period of time, material destruction or scale formations while the cold-water wing remains relatively stable. Similar occurrences are evident in household systems wherein the hot water heater and hot water pipes become corroded while the cold water pipes remain clear.

European Patent Application No. 0 090 384 discloses a method of internally sealing pipes which conduct gas, and more specifically, residential gas lines where leakage in those lines has exceeded a predetermined value. This method however, is solely applicable to low pressure gas lines and not for use in pipes for conducting water or other liquid media which is often highly corrosive and conveyed at a high pressure.

Clearly, there is a need for a method of cleaning and coating the internal surface of water-conducting pipes, so as to reduce the contamination of the water and render extensive disassembling and rerouting of pipes unnecessary.

SUMMARY OF THE INVENTION

In view of the foregoing, it is an object of the present invention to provide a method for cleaning and coating water-conducting pipes whereby existing pipe systems, particularly those of modest dimensions can be overhauled and reused.

A further object of the present invention is to perform such cleaning and coating of water-conducting pipes without the need to remove or reroute the pipe system.

Yet another object of the present invention is to provide a method of cleaning and coating the water-conducting pipes so as to prolong the working life of the pipes of a pipe system.

These as well as other objects are achieved in accordance with the preferred embodiment of the invention wherein a method of cleaning and coating water conducting pipes includes forcing a mixture of water and compressed air through the emptied pipe system to rough clean such system, introducing a pressurized acid into the pipe system and allowing this acid to react with the interior surface of the pipes for a predetermined period of time, draining the acid from the pipes, drying the interior of the pipes with compressed air, introducing pressurized liquid plastic into the pipes to coat the pipes and subsequently draining any excess plastic material from the pipe system.

The initial forcing of the mixture of water and compressed air through the pipe system is continued until any loosened dirt, impurities, or rust particles have been removed. Drainage hoses may be provided at various points throughout the system which lead to a collecting vessel.

Prior to the coating of the cleaned pipe system, the pipe system may be sealed at several points with aeration stoppers. Therefore, after the pipe system has been filled with the liquid plastic, ventilation may be achieved at those selected points. Preferably, the liquid plastic introduced into the pipe system for coating the interior surface of the pipes is introduced into the system at a pressure of approximately 6 atmospheres and is kept in the system for a period of approximately one hour before the excess material is drained from the system. these as well as other advantages will become apparent from the following description to the preferred embodiment.

DETAILED DESCRIPTION OF THE PREFERRED EMBODIMENT

In most existing structures, whether it be a single-family home, a multiple-unit dwelling or a large office complex, the water conducting pipe system is positioned within the walls of the structure during its construction. These pipes may be of diverse materials ranging from galvanized threaded pipes to copper tubing. Particularly, in the case of galvanized threaded pipes, the cause or occurrence which requires the pipes to be overhauled is typically the constant pitting and rusting of these pipes.

In order to carry out the overhaul of the pipe system, the water must be shut off and the pipes must be completely drained. The sanitation fittings and devices such as water spigots and toilets must be disassembled and the gaps in the supply line, arising from their removal must be bridged.

In order for the coating of the interior surface of the pipes to be effective, this interior surface must be cleaned to obtain the barest possible metal substrate i.e. to remove all incrustations, rust spots, and calcareous residues. In order to obtain the bare metal substrate, an initial rough cleaning step is carried out to loosen and remove dirt, impurities, and rust particles, which may be found within the pipes. To do so, a mixture of water and compressed air is fed through an access point into the pipes. At various locations throughout the pipe system drainage hoses are mounted which lead to a collecting vessel. This initial procedure is to be carried out until the return water flowing from the drainage hoses to the collecting vessel is free of noticeable debris.

After this rough cleaning procedure, a fine cleaning or pickling procedure is carried out. Preferably, a pressurized acid is introduced into the pipe system at the same access point as that of the water and compressed air. The particular pressurized acid is chosen to match that of the pipe material. One example of such acid would be hydrochloric acid and the acid is to remain in the pipe system for a length of time which is commensurate with the degree of soiling of the pipes. In doing so, the calcareous products and rust will be desolved and expelled from the system. Additionally, to further accentuate the action of the acid, this acid may be introduced into the pipe system at an elevated temperature. It has been found that by doing so the length of time for the fine cleaning procedure may be reduced. Also, it is considered advantageous to add an inhibitor to the acid which will prevent rust from forming on the inside of the pipe system shortly after the acid has been removed.

Once this fine cleaning procedure has been carried out, the now clean pipe system is dried with compressed air which is again introduced at the same access point as the previous liquids. Once these pipes have been dried to an optimum level, a liquid plastic coating is to be introduced therein. Prior to the introduction of the liquid plastic material, the pipes may be sealed at various locations with aeration stoppers. Once these stoppers have been put in place, a pressure vessel containing the liquid plastic material is hooked up at the access point where the previous liquids have been introduced. Using this pressure vessel, the liquid plastic material is forced into the pipes with the entire surface area of the pipes inside walls being covered.

The particular coating must be chosen so as to be commensurate with the following properties. First, the particular coating material must meet the requirements for drinking water where such is called for. The material must produce a smooth, homogeneous surface which is free of any pores and cracks. It must also be heat resistant as well as abrasion proof to the extent that it can withstand normal water flow operation.

The liquid plastic material is to be introduced into the pipe system at a pressure of approximately six atmospheres and is maintained within the pipe system for a predetermined amount of time which has been found to be approximately one hour; however, this value may differ depending on the size of the material and the pipes. During the introduction of the liquid plastic material into the pipe system, this system must be vented through the aeration stoppers so as to allow for the complete contact of all surfaces of the pipe with the liquid plastic material. Once this coating procedure has taken place, any surplus plastic not adhering to the walls is drained from the system. Further, it is advantageous that the surplus of plastic material not adhering to the pipe walls be blown by way of compressed air from portions of the pipe system which cannot be easily drained.

Upon completion of the above recited method a newly restored pipe system will be realized with coated inside walls again suitable for conducting water. This method not only cleans existing pipe systems but also provides existing pipe systems with an interior surface coating which will prohibit the corrosion of and formation of scale and deposits within the existing pipe system such that the life of the water-conducting system may be prolonged indefinitely. Once these steps have been carried out the sanitary fittings and devices may be replaced in a conventional manner and the system returned to operation.

While the invention has been described with reference to the preferred embodiment, it should be appreciated by those skilled in the art that the invention may be practiced otherwise than as specifically described herein without departing from the spirit and scope of the invention. It is therefore to be understood that the spirit and scope of the invention be limited only by the appended claims.

What is claimed is:

1. A method for cleaning and coating interior surface walls of a water-conducting pipe system comprising the steps of:

a.) draining said water-conducting pipe system;

b.) rough cleaning the interior surface walls of said water-conducting pipe system for forcing a mixture of water and air through the water-conducting pipe system;

c.) fine cleaning the interior surface walls of said water-conducting pipe system by introducing a pressurized acid into the pipe system for an amount of time to fine clean the interior surface walls, said acid being capable of removing at least one of rust and calcareous products from the interior surface walls;

d.) drying the interior surface walls of said water-conducting pipe system;

e.) coating the interior surface walls of said water conducting pipe system with a coating material to prevent access of water conducted through the pipe to the interior surface walls of the pipe, said coating material being water resistant and capable of forming a smooth homogeneous surface; and f.) removing any excess coating material not adhering to said interior surface of said water-conducting pipe system.

2. The method as defined in claim 1, wherein said step of drying said system includes blowing compressed air through said system.

3. The method as defined in claim 1 wherein said coating material is a liquid plastic material.

4. The method as defined in claim 1, further comprising the step of removing all sanitary fixtures after draining said system and bridging gaps formed in said system from the removal of said fixtures.

5. The method as defined in claim 4, further comprising the step of replacing said fixtures after said excess coating material has been removed.

6. The method as defined in claim 3, wherein said liquid plastic is introduced into said system by way of a pressure vessel.

7. The method as defined in claim 6, wherein said liquid plastic is introduced into said system under a pressure of approximately 6 atmospheres.

8. The method as defined in claim 3, wherein said liquid plastic is maintained within said system for a period of time approximately equal to one hour;

9. The method as defined in claim 1, further comprising the step of positioning aeration stoppers within the pipe system prior to said coating step, and ventilating said system through said stoppers after introducing said coating material into said pipe system.

10. The method as defined in claim 1, wherein the step of removing any excess coating material from said pipe system includes blowing compressed air through said system to ensure complete removal of the excess coating material.

11. A method for cleaning and coating interior surface walls of a water-conducting pipe system comprising the steps of:

a.) draining said water-conducting pipe system;

b.) forcing a mixture of water and compressed air through said water-conducting pipe system to rough clean the interior surface walls of said system;

c.) introducing a pressurized acid into said water-conducting pipe system for an amount of time to fine clean the interior surface walls of said system, the acid being capable of removing at least one of rust and calcareous products from the interior surface walls;

d.) blowing compressed air through said water conducting pipe system to dry the interior surface walls of said system;

e.) introducing a liquid plastic material into said water-conducting pipe system to coat the interior surface walls of said system to prevent access of water conducted through the pipe to the interior surface walls of the pipe, said coating material being water resistant and capable of forming a smooth homogeneous surface; and f.) removing any access liquid plastic from the interior of said system.

12. The method as defined in claim 11, further comprising the step of removing all sanitary fixtures after draining said system and bridging gaps formed in said system from the removal of said fixtures.

13. The method as defined in claim 12, further comprising the step of replacing said fixtures after said excess liquid plastic has been removed.

14. The method as defined in claim 11, wherein said liquid plastic is introduced into said system by way of a pressure vessel.

15. The method as defined in claim 14, wherein said liquid plastic is introduced into said system under a pressure of approximately 6 atmospheres.

16. The method ad defined in claim 11, wherein said liquid plastic is maintained within said system for a period of time approximately equal to one hour.

17. The method as defined in claim 11, further comprising the step of positioning aeration stoppers within the pipe system prior to said step of introducing said liquid plastic, and ventilating said system through said stoppers after introducing said liquid plastic into said pipe system.

18. The method as defined in claim 11, wherein the step of removing any excess liquid plastic from said pipe system includes blowing compressed air through said system to ensure complete removal of the excess liquid plastic.

* * * * *